United States Patent [19]

Morris

[11] 4,448,334

[45] May 15, 1984

[54] CONTAINER AND DISPENSER FOR MATERIAL IN GRANULAR OR POWDER FORM

[76] Inventor: William Morris, 383 Ellsworth Ave., New Haven, Conn. 06511

[21] Appl. No.: 340,355

[22] Filed: Jan. 18, 1982

[51] Int. Cl.[3] ..... A47G 19/24

[52] U.S. Cl. ..... 222/230; 222/518

[58] Field of Search ..... 222/142.1, 511, 518, 222/148, 513, 501, 463, 494, 496, 142.1–142.9, 196.2, 196.3, 407, 408.5; 366/130; 239/519, 602

[56] References Cited

U.S. PATENT DOCUMENTS

| | | | |
|---|---|---|---|
| 244,740 | 7/1881 | Brown | 222/408.5 |
| 1,816,141 | 7/1931 | Booty | 222/501 |
| 2,694,512 | 11/1954 | Morris | 222/518 X |
| 2,779,518 | 1/1957 | Morris | 222/518 X |

*Primary Examiner*—Stanley H. Tollberg

*Attorney, Agent, or Firm*—Costas, Montgomery & Dorman

[57] ABSTRACT

A container and dispenser for granular or powdered material in which the container has an upper aperture and dispensing orifices are defined by a flexible member which permits the orifices to be expanded with resulting contraction to break loose clogged material from the orifices.

8 Claims, 3 Drawing Figures

CONTAINER AND DISPENSER FOR MATERIAL IN GRANULAR OR POWDER FORM

FIELD OF THE INVENTION

This invention relates to containers and dispensers for material in granular or powder form and more particularly relates to condiment containers and shakers or dispensers.

BACKGROUND OF THE INVENTION

In containers and dispensers for material in powder or granular form, as for example salt and pepper shakers, it is often found that the opening or openings in the container become clogged requiring the cap to be removed and the dispensing apertures wiped clean to unclog the openings. While this is primarily true in the case of salt and pepper shakers, it may also occur in other dispensing devices where other food substances such as sugar or flour or cornstarch may be wished to be dispensed in limited amounts rather than measured in tablespoon or teaspoons or other measures.

The present invention provides a new and improved container and dispenser where the dispensing openings or means defining the openings for dispensing are resilient and may be enlarged and then contracted to break clogged material away from the dispensing openings.

SUMMARY OF THE INVENTION

Briefly stated, the invention in one form thereof comprises a container including a removable cap member, to permit filling of the container, with the cap member having a dispensing aperture at the top thereof. A conical spring element is disposed in the aperture and supported by the cap member and extends downwardly into the container. The spaces between the helices of the spring member define dispensing orifices and permit the contents of the container to be dispensed therebetween. Should the contents of the container clog the openings between the helices, the container may be impacted on a surface to shock or vibrate the spring and cause it to expand, breaking the clogged material loose from the helices. Alternatively, a plug member may be carried by the lower coil of the spring member so that when the plug member is depressed, the spring member is expanded causing the material to break away from between the helices. The helical dispensing orifices permit a large dispersion area of the contents from the container when the contents are dispensed by inverting and/or shaking the container. The cap and spring member dispenser also provide a new and pleasing appearance.

An object of this invention is to provide a container with a new and improved dispensing orifice for containers for material in granular or powder form.

Another object of this invention is to provide a container with a new and improved dispensing orifice for containers for material in granular or powder form where the dispensing orifices may be expanded to break clogged material therefrom.

A further object of this invention is to provide a container with a new and improved dispensing orifice for containers for materials in granular or powder form in which the dispensing orifices are defined between the helices of a conical spring.

The features of the invention which are believed to be novel are particularly pointed out and distinctly claimed in the concluding portion of this specification.

However, the invention together with further objects and advantages thereof may best be appreciated by reference to the following detailed description taken in conjunction with the drawings.

DETAILED DESCRIPTION OF THE DRAWINGS

DESCRIPTION OF PREFERRED EMBODIMENTS OF THE INVENTION

Figure 1:
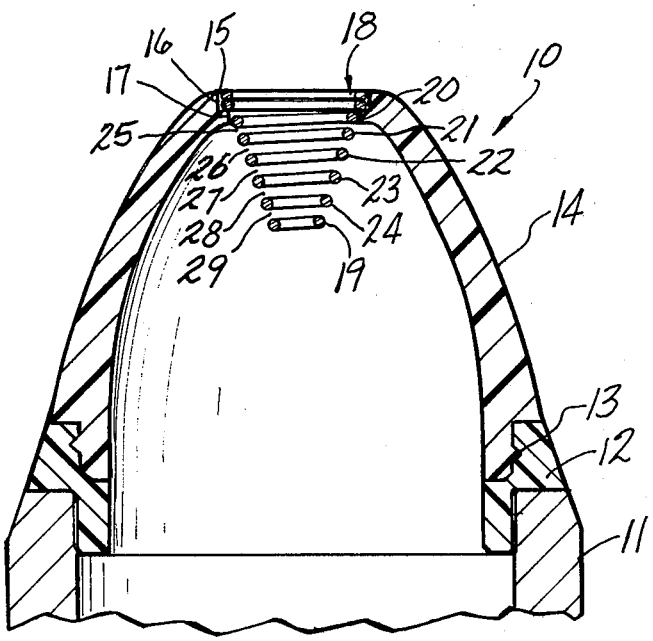
FIG. 1 is a longitudinal sectional view of a container and dispenser for granular and powdered material wheren the bottom portion of the container is partially cut away.

A condiment container 10 embodying the invention in one form thereof comprises a base member 11 receiving an adapter member 12 having internal threads 13 thereon which engage mating threads on a cap member 14. Cap member 14 has an aperture 15 defined in the top thereof. The aperture 15 is defined as cylindrical at 16 with a lower shoulder 17. A dispensing element in the form of a conical spring 18, having in this instance two closed coils of the same diameter **18*a* and 18*b* is seated in aperture 15 on shoulder 17. At least one spring coil will be seated on shoulder 17. The spring element is of a non-corrosive material, preferably stainless steel and comprises helices of decreasing diameter tapering into a lower coil 19. The two upper coils 18*a* and 18*b* are preferably closed or substantially closed coils and are fitted into aperture 16 and rest on shoulder 17. These closed coils may hold the element 18 into cap 14 by a friction fit or lternatively, may be bonded thereto by a suitable adhesive. The spring element 18 further comprises helices 20–24. The spaces, or interstices, between the helices define dispensing orifices 25–29 for the contents of container 10. Also, the coil 19 defines a small opening for dispensing of the contents as shown in FIG. 1**.

In operation, the container 10 is inverted and depending on the contents, if in powder form, may be dispensed through the spaces 25–29 between the helices as well as the opening in coil 19, or alternatively, the container while inverted may be shook to dispense the contents of the container.

If the contents of the container 10 should clog, the interstices between the helices or the opening in coil 19, the container may be impacted on a surface. The shock and vibration of such impaction will produce useful extension and resulting contraction of the helices of the spring and the interstices therebetween, causing the contents to break loose, and thereby open the interstices between the helices to permit the free dispensing of the contents.

Figure 2:
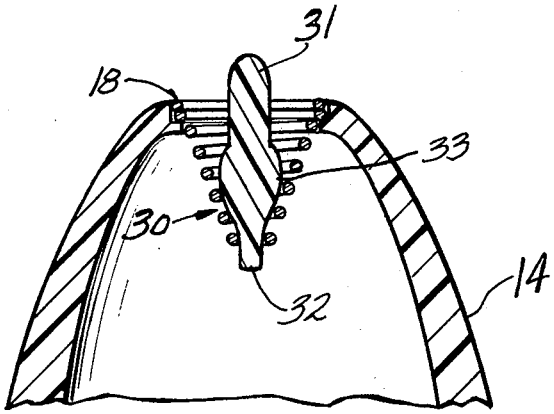
FIG. 2 is a longitudinal half section of an additional embodiment of the invention.
Figure 3:
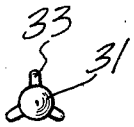
FIG. 3 is a plan view of an element of FIG. 2.

FIG. 2 shows an alternate embodiment of the invention in which a plug member 30 may be utilized to expand spring element 18. The plug element 30 has an upper stem 31 adapted to be manipulated by the finger and a lower stem 32 which is frictionally engaged and held within lower coil 19. The plug also has three ribs 33 which contact one or more of the coils. At least one helix is in surface contact with the ribs of plug 30. In this embodiment, the contents of container 10 are dispensed through the interstices of spring element 18. The ribs 33 also permit dispensing therebetween and do not significantly interfere with dispensing between the lower coils. Should there be a clogging of the interstices, the user merely has to depress the plug 30 and expand the spring one or more times to break loose the clogging material from the helices and permit the free flow or shaking of the contents of the container. The frictional fit of lower stem 32 of plug 30 in coil 19 plus the contact of the ribs of the plug with the helices provides for linear expansion of the spring upon depression of plug 30.

In practice, the last turn or coil 19 of the spring element 18 need not be on a helix but may be substantially planar to define the opening in the apex of the spring element 18 and also be dimensioned to frictionally engage the lower stem 32 of the plug.

The number of coils of the spring element and the dimensioning of the interstices therebetween may be selected for a given dispersion of the contents as well as the type of contents.

In practice, the spacings between the helices may be on the order of 0.015–0.020 inches. Where salt and pepper are to be dispensed, the opening defined by coil 19 may be slightly larger.

As shown, the device comprises a wooden bottom 11 with plastic adapter 12 and top 14. However, it may be made of plastic bottom and top members omitting the adapter, or any other suitable materials.

While preferred embodiments of the invention have been set forth for purposes of disclosure, other embodiments of the invention as well as modifications to the disclosed embodiments may occur to those skilled in the art. Accordingly, the appended claims are intended to cover all embodiments of the invention which do not depart form the spirit and scope thereof.

Having thus described the invention, what is claimed is:

1. A device for containing and dispensing material in granular or powder form comprising a container, a substantially unrestricted outlet opening defined at the upper end of said container, a spring member of conical shape defined by helices of decreasing diameter about a longitudinal axis, said helices being uniformly spaced apart along the axis to permit dispensing of material therethrough, said member being affixed to said container in said opening adjacent the larger helices thereof and depending into said container, the smallest helix defining a dispensing opening along said axis, whereby a substance in said container may be dispensed between helices of said member, and said spring may be extended to break a build-up of material between said helices.

2. The device of claim 1 further including a plug member seated within said spring member whereby when said plug member is depressed said spring member is extended, said plug member being of lesser diameter than the opening in said container.

3. The device of claim 2 wherein said plug member has upper and lower stems and said lower stem is frictionally held in said smallest helix of said spring member.

4. The device of claim 1 wherein said container defines a shoulder in said opening, and said spring has two closed coils supported on said shoulder.

5. The container of claim 1 wherein said container defines a shoulder in said opening and at least one coil of said spring is supported on said shoulder.

6. The container of claim 1 comprising a base member and a cap member, said outlet opening being defined in said cap member.

7. The container of claim 6 wherein said cap member defines a shoulder in said opening and at least one coil of said spring is supported on said shoulder.

8. The container of claim 6 wherein said cap member defines a shoulder in said opening and said spring has two closed coils supported on said shoulder.

* * * * *